US006266986B1

(12) United States Patent
Morita et al.

(10) Patent No.: US 6,266,986 B1
(45) Date of Patent: Jul. 31, 2001

(54) NOZZLE FOR HYDROSTATIC FORMING AND HYDROSTATIC FORMING SYSTEM USING SAME NOZZLE

(75) Inventors: Tsukasa Morita; Masanobu Hayasaka, both of Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/478,988

(22) Filed: Jan. 7, 2000

(30) Foreign Application Priority Data

Jan. 14, 1999 (JP) ..... 11-007353

(51) Int. Cl.[7] ..... B21D 39/20; B21D 22/10
(52) U.S. Cl. ..... 72/58; 72/61
(58) Field of Search ..... 72/58, 61, 62

(56) References Cited

U.S. PATENT DOCUMENTS 4,567,743 * 2/1986 Cudini ..... 72/61
4,761,982 * 8/1988 Snyder ..... 72/58
5,815,901 10/1998 Mason et al. .

FOREIGN PATENT DOCUMENTS 198 12 884 A1 9/1999 (DE) .
8-168814 7/1996 (JP) .

* cited by examiner

*Primary Examiner*—David B. Jones
(74) *Attorney, Agent, or Firm*—McDermott, Will & Emery

(57) ABSTRACT

A nozzle to be used for hydrostatic forming, through which pressurized fluid is supplied into a tube located inside a die. The nozzle comprising a fitting section integrally connected to a base section and insertable into an end section of the tube so as to be fitted in the tube. The fitting section has an opening through which the pressurized fluid is ejected to be supplied into the tube. The fitting section has a generally rectangular cross-section in a place perpendicular to an axis of the nozzle.

9 Claims, 8 Drawing Sheets

NOZZLE FOR HYDROSTATIC FORMING AND HYDROSTATIC FORMING SYSTEM USING SAME NOZZLE

BACKGROUND OF THE INVENTION

This invention relates to improvements in a nozzle to be used for hydrostatic forming, for example, of a frame of an automotive vehicle, and to a hydrostatic forming system using such a nozzle.

Hitherto a frame and the like of an automotive vehicle have been produced mainly by a hydrostatic forming system or apparatus. The hydrostatic forming system usually includes upper and lower dies mounted on a base, and hydrostatic forming nozzles secured to hydraulic cylinders. In hydrostatic forming with such a hydrostatic forming system, the tip end sections of the hydrostatic forming nozzles are respectively inserted into the opposite end sections of a tube (raw material) located between the upper and lower dies, under pressure of the hydraulic cylinders. Then, pressurized fluid is supplied through the nozzles into the tube, so that the tube is formed into a desired formed product.

However, difficulties have been encountered in the above earlier technique. That is, since each hydrostatic forming nozzle has usually a circular cross-section, the formed product or semi-product after the hydrostatic forming has a surplus section in addition to a product section corresponding to an actual product such as the automotive vehicle frame. The surplus section is a section into which the nozzle has been fitted. The actual product has, in general, a non-circular cross-section such as a rectangular cross-section, and therefore the above surplus section is unnecessary for the actual product. As a result, it is required to remove the surplus section, so that the surplus section is useless. This is not desirable to lower a production cost for the actual product.

SUMMARY OF THE INVENTION

It is an object of the present invention to provide an improved hydrostatic forming nozzle which can effectively overcome drawbacks encountered in conventional and earlier technique hydrostatic forming nozzles.

Another object of the present invention is to provide an improved hydrostatic forming nozzle which can effectively save waste of raw material thereby lowering production cost of a product.

A further object of the present invention is to provide an improved hydrostatic forming nozzle which can effectively suppress formation of a surplus section in a formed product or semi-product, thereby raising a production efficiency for an actual product such as a frame of an automotive vehicle.

A still further object of the present invention is to provide an improved hydrostatic forming nozzle which has a cross-sectional shape similar to the cross-sectional shape of an actual product which is obtained through a semi-product produced by a hydrostatic forming system using the hydrostatic forming nozzle.

An aspect of the present invention resides in a nozzle for hydrostatic forming, through which pressurized fluid is supplied into a tube located inside a die. The nozzle comprises a base section. A fitting section is connected to the base section and insertable into an end section of the tube so as to be fitted in the tube. The fitting section has an opening through which the pressurized fluid is ejected to be supplied into the tube. The fitting section has a generally rectangular cross-section.

Another aspect of the present invention resides in a hydrostatic forming system which comprises a die inside which a tube is located. A nozzle is provided including a base section, and a fitting section connected to the base section. The fitting section is insertable into an end section of the tube so as to be fitted in the tube. The fitting section has an opening through which pressurized fluid is ejected to be supplied into the tube, the nozzle having a generally rectangular cross-section.

A further aspect of the present invention resides in a hydrostatic forming method for a tube. The method comprises (a) preparing a nozzle including a fitting section which has a generally rectangular cross-section and is formed with an opening through which pressurized fluid is ejected; (b) locating the tube inside a die; (c) inserting the fitting section of the nozzle into an end section of the tube so as to be fitted in the tube end section; and (d) supplying the pressurized fluid through the opening of the nozzle into the tube located inside the die.

A still further aspect of the present invention resides in a product to be formed by a hydrostatic forming system including a die inside which a tube is located; and a nozzle including a base section, and a fitting section connected to the base section and insertable into an end section of the tube so as to be fitted in the tube, the fitting section having an opening through which pressurized fluid is ejected to be supplied into the tube, the nozzle having a generally rectangular cross-section. The product comprises a main section having a generally rectangular cross-section. An end section is integral with the main section, in which the fitting section of the nozzle having been extracted from the end section, the end section having a generally rectangular cross-section.

BRIEF DESCRIPTION OF THE DRAWINGS

In the drawings, like reference numerals designate like parts and elements throughout all figures.

DETAILED DESCRIPTION OF THE INVENTION

Figure 1:
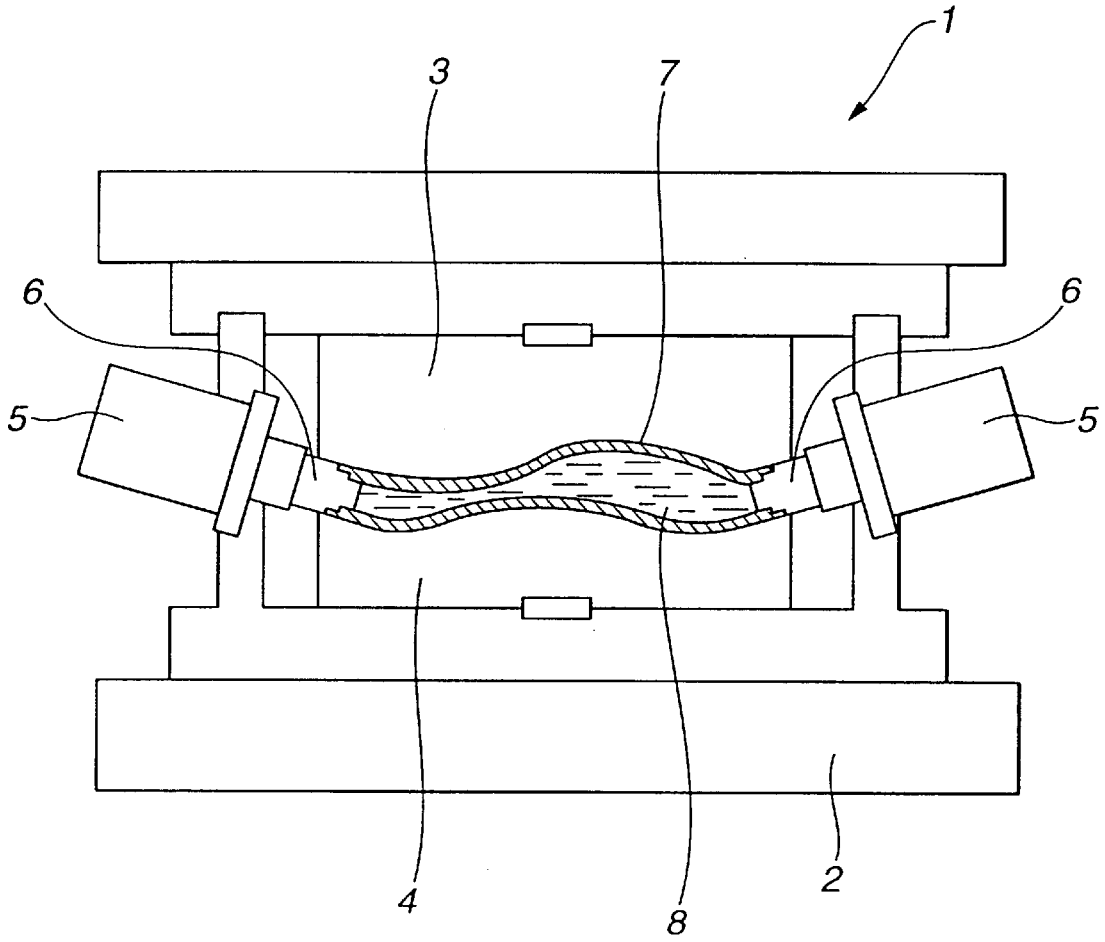
FIG.1 (PRIOR ART)
FIG. 1 is a schematic illustration of a hydrostatic forming system using a hydrostatic forming nozzle of an earlier technique.

To facilitate understanding of the present invention, a brief reference will be made to a hydrostatic forming system or apparatus 1 of an earlier technology, depicted in FIGS. 1 to 3C. Referring to FIG. 1, the hydrostatic forming system 1 includes a base 2 on which upper and lower dies 3, 4 are mounted. Hydraulic cylinders 5, 5 are incorporated in the hydrostatic forming system 1, and are respectively provided at their tip end section with hydrostatic forming nozzles 6, 6. The hydrostatic forming system 1 is used to produce a formed product 14 such as a frame of an automotive vehicle.

The hydrostatic forming system 1 operates to produce the formed product, as follows: First, a tube (raw material) is located between the upper and lower dies 3, 4 as it is or after being subject to a preliminary forming such as bending or squeezing. Subsequently, the tip end sections of the hydrostatic forming nozzles 6, 6 are respectively inserted into the opposite end sections of the tube 7, and then pressed by the hydraulic cylinders 5, 5 to be brought into tight fit in the opposite end sections of the tube 7. Thereafter, under the action of the hydraulic cylinders 5, 5, the nozzles 6, 6 are respectively further thrust into a cavity formed between the upper and lower dies 3, 4. Then, pressurized fluid 8 supplied from a hydraulic system (not shown) is ejected from the tip ends of the nozzles 6, 6, in which the ejected pressurized fluid 8 is introduced under pressure into the tube 7. As a result, hydrostatic forming is accomplished from the inside of the tube 7, thereby obtaining the desired formed product 14.

Figure 2A:
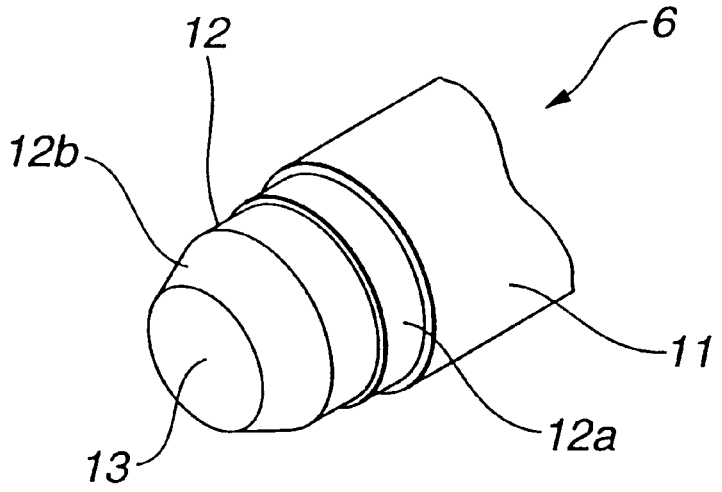
FIG.2A (PRIOR ART)
FIG. 2A is a fragmentary perspective view of the nozzle of FIG. 1.
Figure 2B:
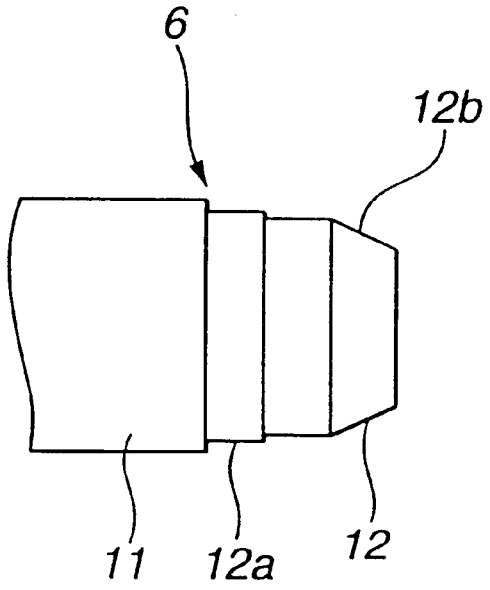
FIG.2B (PRIOR ART)
FIG. 2B is a fragmentary front view of the nozzle of FIG. 1.

The hydrostatic forming nozzle 6 is shown in FIGS. 2A and 2B. The nozzle 6 is secured to the tip end of the hydraulic cylinder 5 so as to be axially movable under operation of the hydraulic cylinder 5. The nozzle 6 includes an elongate base section 11 which is connected to the hydraulic cylinder 5 and has a generally circular cross-section. A fitting section 12 is integrally formed on the tip end of the base section 11 and includes a base portion 12*a* and a tip end section 12*b*. The base portion 12*a* and the tip end portion 12*b* of the fitting section 12 have a generally circular cross-section. The tip end portion 12*b* is in the shape of a frustum of cone, and is formed at its tip end with an opening 13 through which the pressurized fluid is ejected to be supplied into the tube 7 during hydrostatic forming.

Figure 3A:
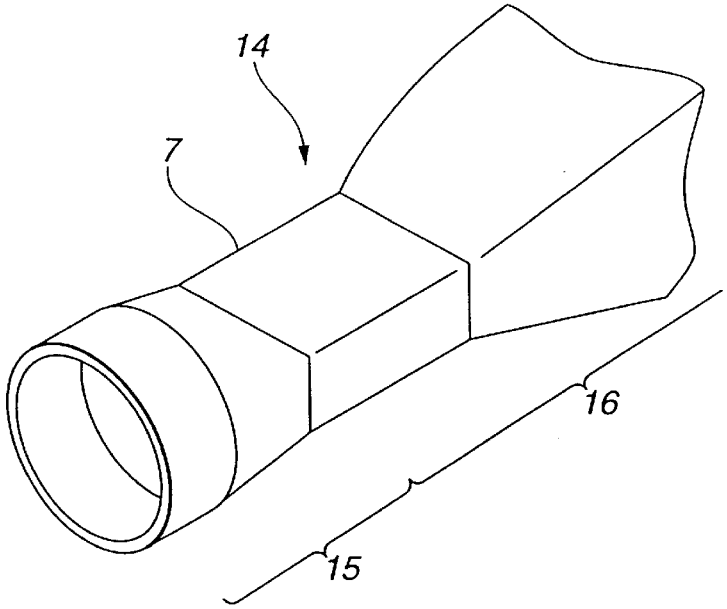
FIG.3A (PRIOR ART)
FIG. 3A is a fragmentary perspective view of a formed product produced by the hydrostatic forming system of FIG. 1.
Figure 3B:
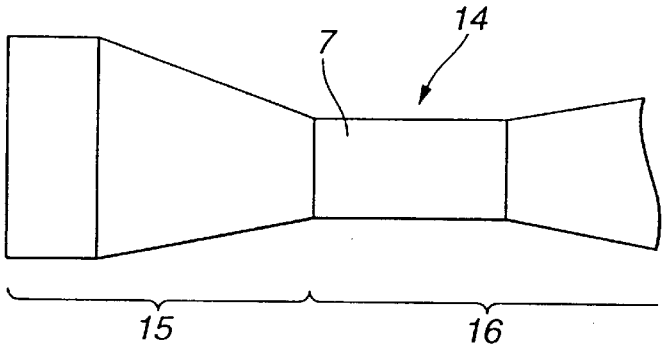
FIG.3B (PRIOR ART)
FIG. 3B is a fragmentary front view of the formed product of FIG. 3A.

Thus, the hydrostatic forming nozzle 6A has a circular cross-section. This is because a cylindrical pipe having a circular cross-section is usually used as the tube (the raw material) 7, in which the nozzle 6 is preferable to have the circular cross-section in order to obtain a good sealing between the tube 7 and the nozzle 6. As a result, as shown in FIGS. 3A and 3B, the formed product or semi-product 14 after the hydrostatic forming has a surplus section 15 in addition to a product section 16 corresponding to an actual product shown in FIG. 3C. It will be understood that the surplus section 15 is a section into which the nozzle 6A has been fitted, while the product section 16 is to be used as the actual product such as the automotive vehicle frame. Additionally, in case of carrying out the above-mentioned preliminary forming for the tube (raw material), it is required to make an operation for the preliminary forming, previously taking account of the section into which the nozzle 6 is fitted. As a result, the surplus section 14 is unavoidably formed.

Figure 3C:
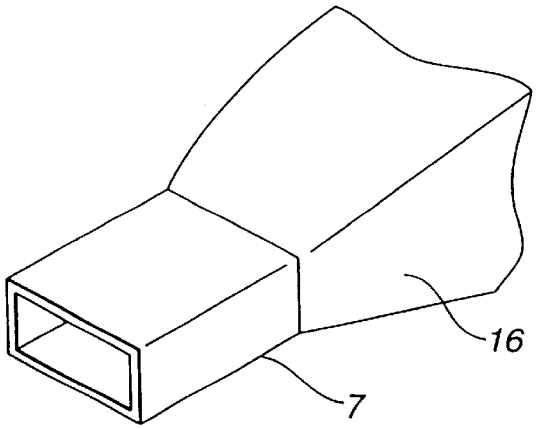
FIG.3C (PRIOR ART)
FIG. 3C is a fragmentary perspective view of an actual product produced through the formed product (semi-product) of FIG. 3A.

However, the actual product 16 formed from the tube 7 has, in general, a non-circular cross-section such as a rectangular cross-section, and therefore the above surplus section 14 is unnecessary for the actual product 16 shown in FIG. 3C. Accordingly, it is required to remove the surplus section 15, so that the surplus section 15 is useless. This is not desirable to lower a production cost for the actual product 16.

Figure 4:
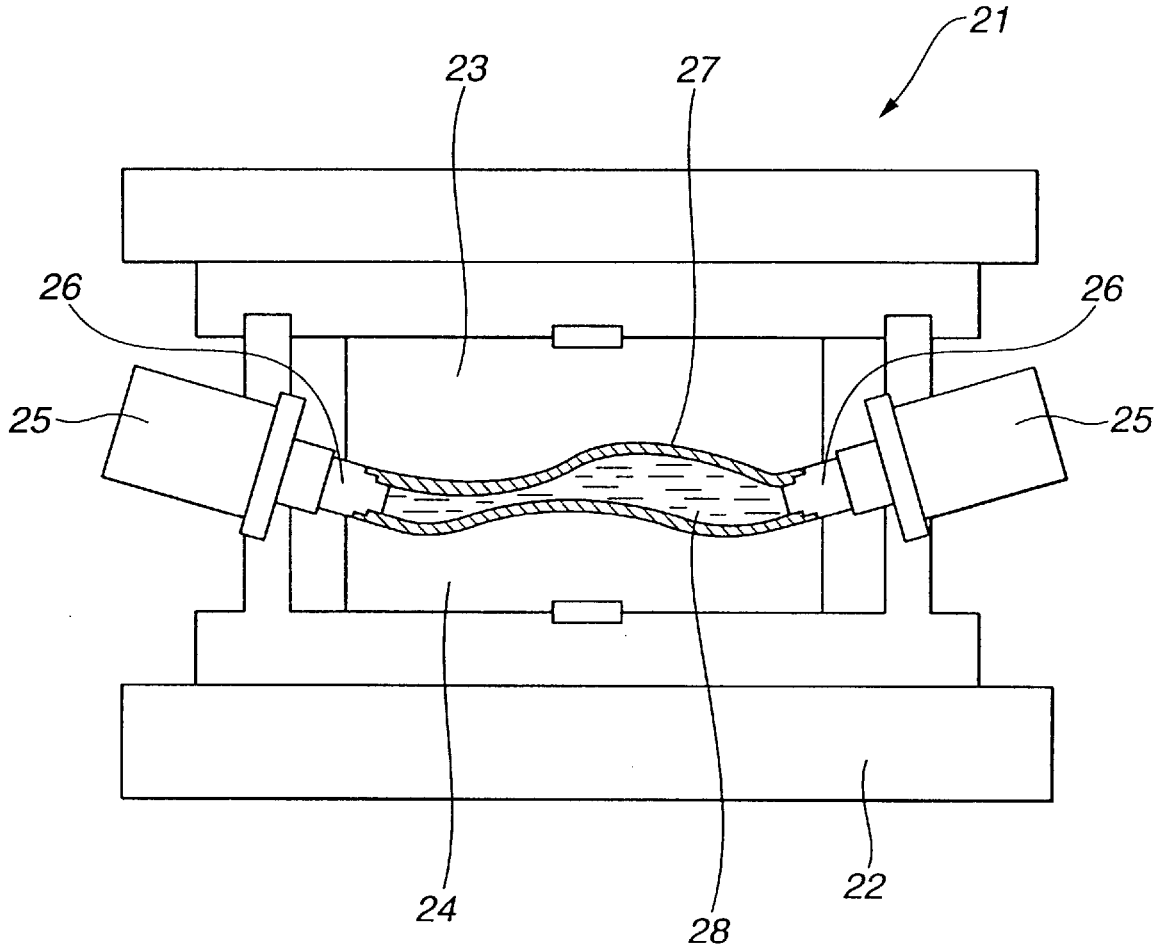
FIG. 4 is a schematic illustration of a hydrostatic forming system using a hydrostatic forming nozzle according to the present invention.
Figure 5:
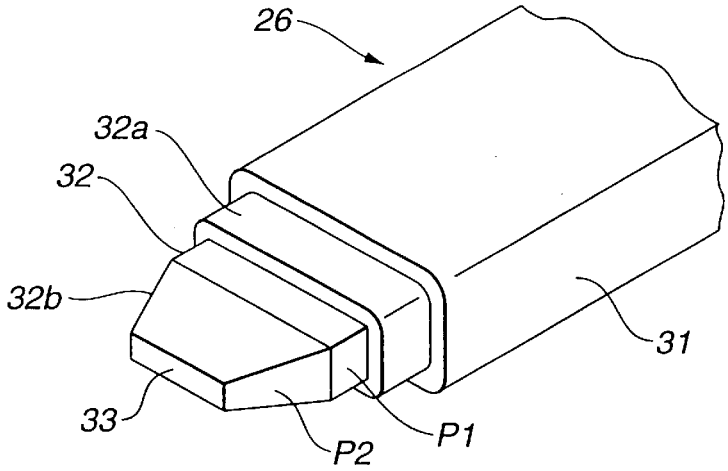
FIG. 5 is a fragmentary perspective view of a first example of the nozzle of FIG. 4.
Figure 6:
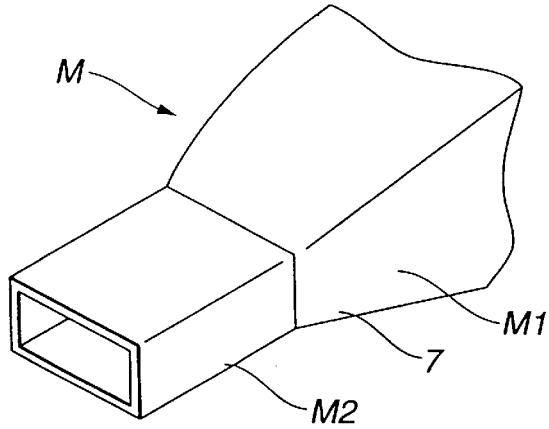
FIG. 6 is a fragmentary perspective view of a formed product produced by the hydrostatic forming system of FIG. 4 using the nozzle of FIG. 5.

In view of the above description of the hydrostatic forming system of the earlier technique, reference is now made to FIGS. 4 to 13, and more specifically to FIGS. 4 and 5, wherein an embodiment of a hydrostatic forming system or apparatus according to the present invention is illustrated by the reference numeral 21. The hydrostatic forming system 21 comprises a base 22 on which upper and lower dies23, 24 are mounted. Hydraulic cylinders 25,25 are incorporated in the hydrostatic forming system 21. The hydraulic cylinders 25, 25 are respectively provided at their tip end section with hydrostatic forming nozzles 26, 26. The hydrostatic forming system of this embodiment is used to produce a formed product such as a frame of an automotive vehicle.

The hydrostatic forming system 21 operates to produce the formed product as follows: First, a tube (raw material) 27 is located between the upper and lower dies 23, 24 as it is or after being subject to a preliminary forming such as bending or squeezing. Subsequently, the tip end sections of the hydrostatic forming nozzles 26, 26 are respectively inserted into the opposite end sections of the tube 27. Then, the tip end sections of the hydrostatic forming nozzles 26, 26 are pressed by the hydraulic cylinders 25, 25 to be brought into tight fit in the opposite end sections of the tube 27. Thereafter, under the action of the hydraulic cylinders 25, 25, the nozzles 26, 26 are respectively thrust into a cavity formed between the upper and lower dies 23, 24. Then, pressurized fluid 28 supplied from a hydraulic system (not shown) is ejected from the tip ends of the nozzles 26, 26, in which the ejected pressurized fluid 28 is introduced under pressure into the tube 27. As a result, hydrostatic forming is accomplished on the tube 27 from the inside of the tube 27, thereby obtaining a desired formed product, for example, one M (such as the automotive vehicle frame) shown in FIG. 6.

A first example of the nozzle 26 for hydrostatic forming is shown in FIG. 5. The nozzle 26 is secured to the tip end of the hydraulic cylinder 25 so as to be axially movable under operation of the hydraulic cylinder 25. The nozzle 26 includes an elongate base section 31 which is connected to the hydraulic cylinder 25 and has a generally rectangular cross-section (defined by the profile or outer periphery) in an imaginary plane perpendicular to the axis of the nozzle 26. A fitting section 32 is integrally formed on the tip end of the base section 31 and includes a base portion 32*a* which is directly connected to the tip end of the base section 31. The fitting section 32 further includes a tip end section 32*b* integrally formed on the tip end of the base portion 32*a*. The base portion 32*a* and the tip end portion 32*b* of the fitting section 32 are coaxial with the base section 31 and have a generally rectangular cross-section (defined by the profile or outer periphery) in any imaginary plane perpendicular to the axis of the nozzle 26. The tip end portion 32*b* includes a base part P1 of a generally rectangular parallelepiped, which part P1 is directly connected to the base portion 32*a*. A tip part P2 is integral with the base part P1 and formed in the shape of a frustum of pyramid, in which its cross-sectional area (defined by the profile) gradually decreases toward its tip end. In other words, the tip end portion 32*b* is formed generally wedge-shaped so as to allow the nozzle 26 to be easily inserted into the tube 27. The tip end portion 32*b* is formed at its tip end with an opening 33 through which the pressurized fluid 28 is ejected to be supplied into the tube 37 during hydrostatic forming for the tube 37.

Thus, the nozzle 26 has the rectangular cross-section. This is intended to avoid formation of the surplus section (14) shown in FIGS. 3A and 3B which surplus section is unavoidably formed during production under the earlier technique in which the nozzle (6) is inserted into the surplus section because the product, in general, has the non-circular cross-section such as the rectangular cross-section. In other words, by forming the cross-section of the nozzle 26 into the rectangular shape, i.e., a shape similar to the cross-sectional shape of the product, it is avoided to form the surplus section (14) thereby reducing a useless part of the tube 27. Accordingly, by virtue of the nozzle 26 having the generally rectangular cross-section, the formed product can have the shape shown in FIG. 6. The formed product in FIG. 6 includes a main section M1, and an end section M2, in which the cross-section is generally rectangular throughout the main and end sections M1, M2. Additionally, in case of carrying out the above-mentioned preliminary forming for the tube (the raw material), an operation for the preliminary forming can be made without previously taking account of a section into which the nozzle 26 is fitted. As a result, the surplus section (14) is not formed while realizing an effective operation for the preliminary forming.

Figure 7:
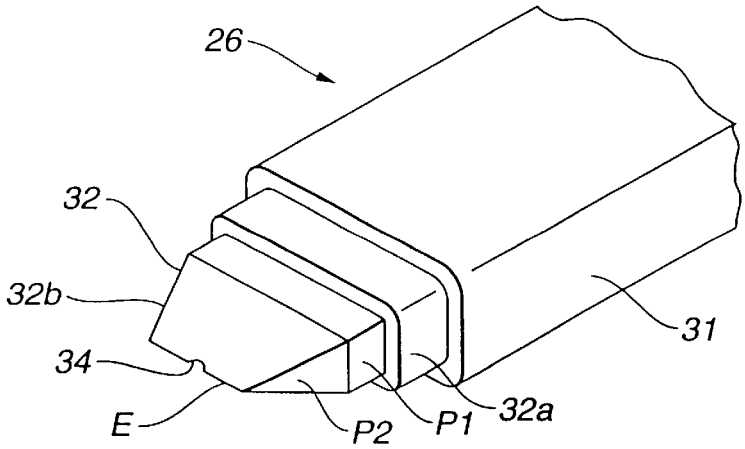
FIG. 7 is a fragmentary perspective view of a second example of the nozzle of FIG. 4.

FIG. 7 shows a second example of the nozzle 26 for hydrostatic forming, which is similar to the first example of FIG. 5 with the following exception: The tip end of the tip end portion 32*b* is formed into an edge-shape so as to form a laterally extending edge E. The edge E is formed with an ejection hole 34 through which the pressurized fluid is ejected to be supplied into the tube 37 during hydrostatic forming for the tube 37. While the single ejection hole 34 has been shown and described in connection with this example, it will be understood that a plurality of ejection holes 34 may be formed at the laterally extending edge E.

Figure 8:
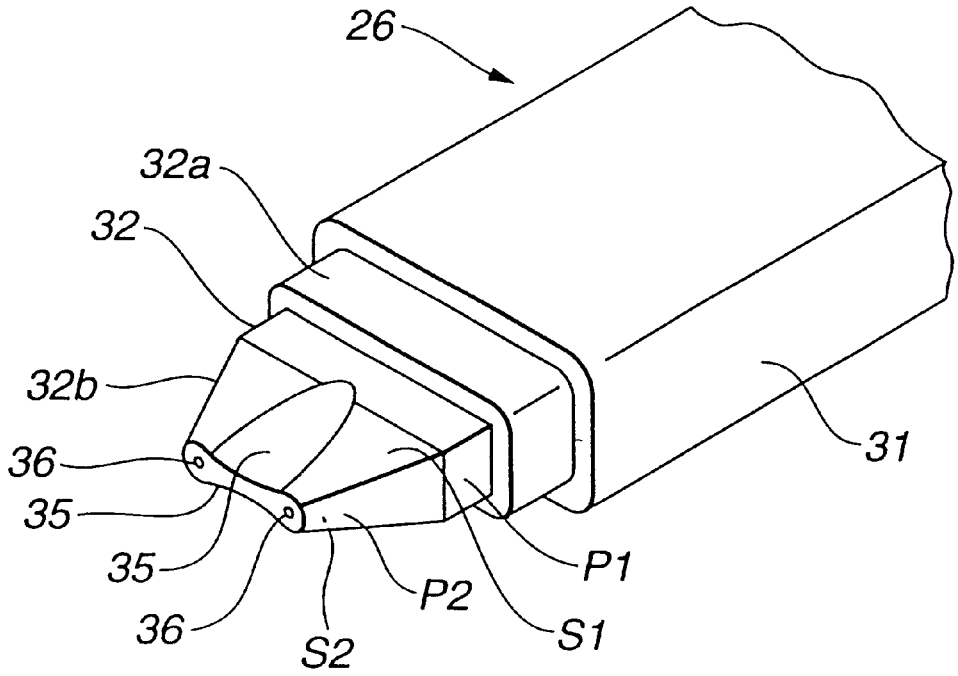
FIG. 8 is a fragmentary perspective view of a third example of the nozzle of FIG. 4.

FIG. 8 shows a third example of the nozzle 26 for hydrostatic forming, which is similar to the first example shown in FIG. 5 with the following exception: The tip end portion 32*b* of the fitting section 32 of the nozzle 26 has upper and lower tapered surfaces S1, S2 at which depressions 35, 35 are respectively formed. Each depression 35 is formed at a central part of the tapered surface S1, S2 and extends generally in the axial direction of the nozzle 26 in such a manner as to reach the tip end of the tip end portion 32*b*. In this example, the tip end portion 32*b* is formed at its tip end with two ejection holes 36 through which the pressurized fluid 28 is ejected to be supplied into the tube 37 during hydrostatic forming for the tube 37. The two ejection holes 36, 36 are located laterally outside the depression 35.

The depressions 35, 35 are provided for the reasons set forth below. That is, in case of carrying the above-mentioned preliminary forming, particularly squeezing on the tube 27, the tube 27 is deformed into a shape having a cross-section shown in FIG. 9 in which upper and lower axially central parts of the tube 27 approach to each other. Even in such a case, the nozzle 26 can be smoothly inserted into the thus deformed tube 27 by virtue of the depressions 35, 35 prior to the hydrostatic forming to be made on the tube 27. It will be understood that one of the depressions 35, 35 may be omitted.

Figure 10:
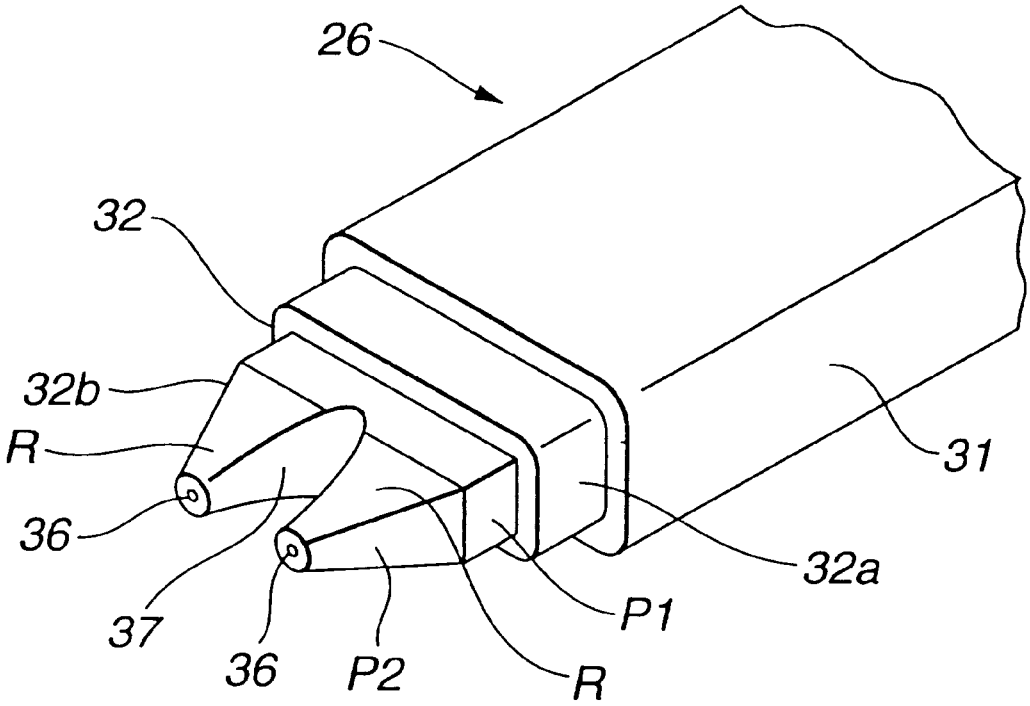
FIG. 10 is a fragmentary perspective view of a fourth example of the nozzle of FIG. 4.

FIG. 10 shows a fourth example of the nozzle 26 for hydrostatic forming, which is similar to the third embodiment shown in FIG. 8 with the following exception: The tip end portion 32*b* of the fitting section 32 of the nozzle 26 is formed with a cutout 37 which reaches from the upper to lower tapered surfaces S1, S2. The cutout 37 is formed at a central part of the tip end portion 32*b* and extends generally in the axial direction of the nozzle 26 from the tip end of the tip part P1 to the base part P2 of the tip end portion 32*b*. In other words, the tip end portion 32*b* of this example is formed into such a shape wherein two axially extending projections R, R are left on the opposite sides of the cutout 37, each projection R being generally in the shape of a frustum pyramid.

The cutout 37 is provided for the reasons set forth below. That is, in case of carrying the above-mentioned squeezing on the tube 27 as a preliminary forming, the tube 27 is deformed into a shape having a cross-section shown in FIG. 11 in which upper and lower axially central parts of the tube 27 are brought into contact with each other. Even in such a case, the nozzle 26 can be smoothly inserted into the thus deformed tube 27 by virtue of the cutout 37 prior to the hydrostatic forming to be made on the tube 27.

Figure 9:
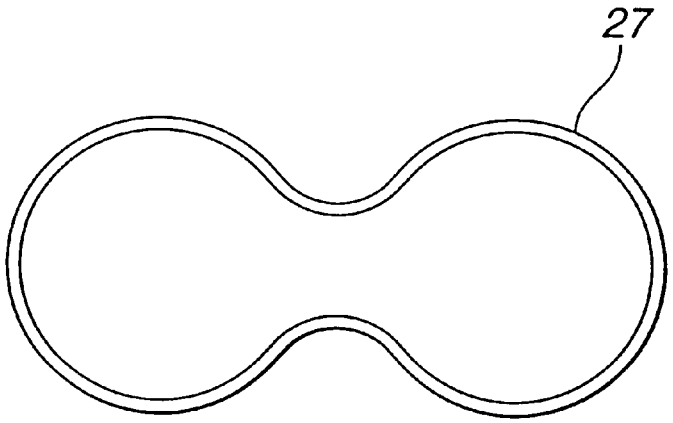
FIG. 9 is a cross-sectional view of a tube which has been subjected to a preliminary forming and will be subjected to a hydrostatic forming, in connection with the nozzle of FIG. 8.
Figure 12:
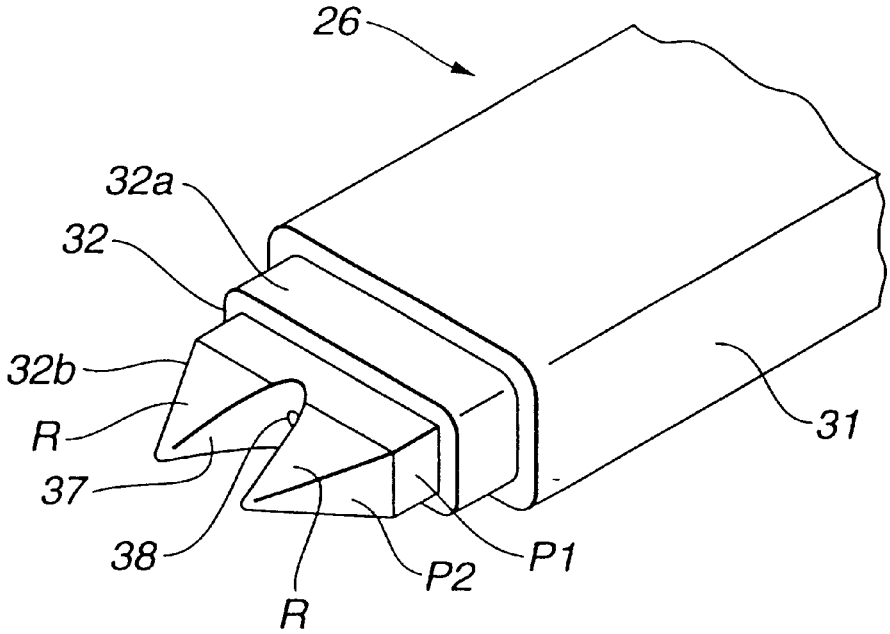
FIG. 12 is a fragmentary perspective view of a fifth example of the nozzle of FIG. 4.

FIG. 12 shows a fifth example of the nozzle 26 for hydrostatic forming, which is similar to the fourth example shown in FIG. 9 with the following exception: The tip end portion 32*b* of the fitting section 32 of the nozzle 26 is formed with the cutout 37, leaving two axially extending projections R, R each of which is generally in the shape of pyramid in place of the shape of the frustum of pyramid in the fourth example. In this example, an ejection hole 38 is formed at the bottom of the cutout 37 so as to be opened to the base part P1 of the tip end portion 32*b*. The pressurized fluid 28 is ejected through the ejection hole 38 so as to be supplied into the tube 37 during hydrostatic forming for the tube 37.

Figure 11:
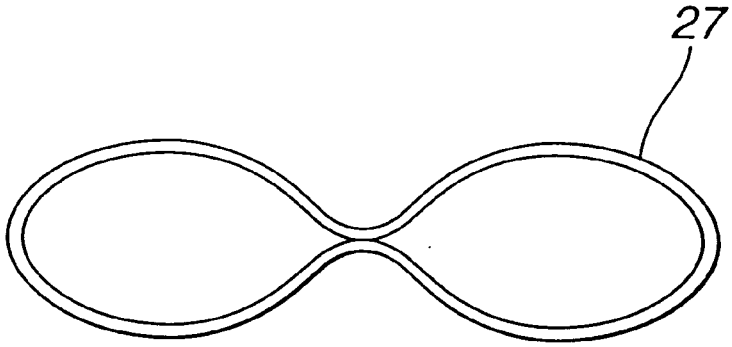
FIG. 11 is a cross-sectional view of a tube which has been subjected to a preliminary forming and will be subjected to a hydrostatic forming, in connection with the nozzle of FIG. 10.
Figure 13:
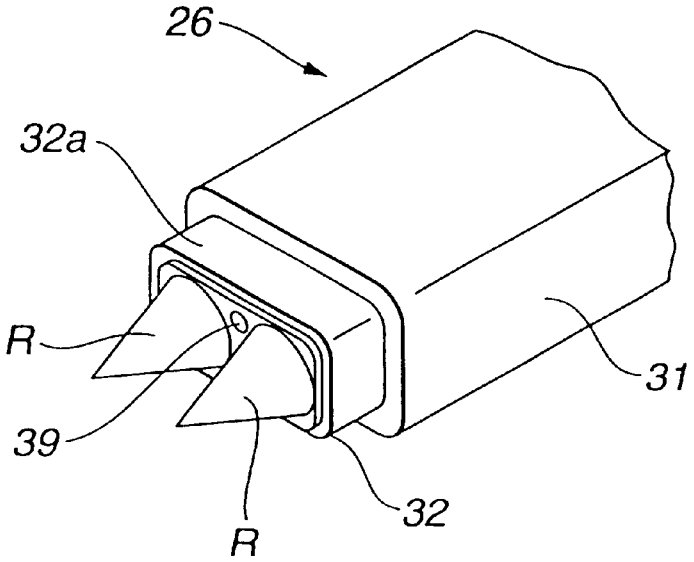
FIG. 13 is a fragmentary perspective view of a sixth example of the nozzle of FIG. 4.

FIG. 13 shows a sixth example of the nozzle 26 for hydrostatic forming, which is similar to the fifth example of FIG. 12 with the following exception: Two axially extending projections R, R are formed integral with the base portion 32*a* of the fitting section 32. Each projection R is generally in the shape of a cone, in which the projection R is tapered toward the tip end of the nozzle 26. In this example, an ejection hole 39 is formed between the two projections R, R so as to be opened to the base portion 32*a* of the fitting section 32. The pressurized fluid 28 is ejected through the ejection hole 39 so as to be supplied into the tube 37 during hydrostatic forming for the tube 37. It will be appreciated that the projections R, R of this example function similarly to the projections P, P in the fourth and fifth examples shown in FIGS. 10 and 12, so that the nozzle 26 can be easily inserted into the tube 27 even in case that the tube 27 is deformed as shown in FIGS. 9 and 11.

As appreciated from the above, the nozzle 26 according to the present invention has the fitting section 32 whose cross-section is generally rectangular or in a shape similar to the cross-section of the product after the hydrostatic forming. This can omit or sharply reduce formation of the surplus section (14) of the semi-product under the earlier technique in which the nozzle having the circular cross-section is used. As a result, the useless (surplus) section of the tube (raw material) can be reduced thereby contributing to a production cost reduction. Additionally, omitting or sharply reducing formation of the surplus section achieves making the hydrostatic forming system itself small-sized, thereby lowering a cost required for production of the dies. Besides, by virtue of omitting or sharply reducing formation of the surplus section, a force for thrusting the nozzle into the tube under the action of the hydraulic cylinder is directly acted on a part (to be hydrostatically formed) of the tube, and therefore the thrust amount or distance of the nozzle into the tube can be reduced.

While the nozzles for hydrostatic forming have been shown and described as the examples, it will be understood that the nozzles are not limited to the examples. For example, in case of the nozzle shown in FIG. 5, the opening 33 may be replaced with a plurality of ejection holes. In case of the nozzle shown in FIG. 7, the ejection hole 34 may be replaced with a plurality of ejection holes 34. In case of the nozzle shown in FIG. 13, the ejection hole 39 may be replaced with two ejection holes formed respectively at the tip ends of the conical projections r, R.

The entire contents of Japanese Patent Applications P11-7353 (filed Jan. 14, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A nozzle for hydrostatic forming, through which pressurized fluid is supplied into a tube located inside a die, said nozzle comprising:

a base section; and a fitting section connected to said base section and insertable into an end section of the tube so as to be fitted in the tube, said fitting section having an opening through which the pressurized fluid is ejected to be supplied into the tube, said fitting section having a generally rectangular cross-section, said fitting section including a tip end portion which is formed with first and second opposite surfaces; and a depression formed in at least one of the first and second opposite surfaces, said depression being located generally at a central part of the at least one of the first and second opposite surfaces in which it is formed.

2. A nozzle as claimed in claim 1, wherein the generally rectangular cross-section is in a plane perpendicular to an axis of said nozzle, and defined by an outer periphery of said fitting section.

3. A nozzle for hydrostatic forming, through which pressurized fluid is supplied into a tube located inside a die, said nozzle comprising:

a base section; and a fitting section connected to said base section and insertable into an end section of the tube so as to be fitted in the tube, said fitting section having an opening through which the pressurized fluid is ejected to be supplied into the tube, said fitting section having a generally rectangular cross-section, said fitting section including a tip end portion which is formed with a cutout located generally at a central part thereof, said cutout axially extending from a tip end of said tip end portion toward a rear part of said tip end section.

4. A nozzle for hydrostatic forming, through which pressurized fluid is supplied into a tube located inside a die, said nozzle comprising:

a base section; and a fitting section connected to said base section and insertable into an end section of the tube so as to be fitted in the tube, said fitting section having an opening through which the pressurized fluid is ejected to be supplied into the tube, said fitting section having a generally rectangular cross-section, said fitting section including a tip end portion which is formed with a cutout located generally at a central part thereof, said cutout axially extending from a tip end of said tip end portion toward a rear part of said tip end section, said pressurized fluid ejection opening being opened to a surface defining said cutout.

5. A nozzle for hydrostatic forming, through which pressurized fluid is supplied into a tube located inside a die, said nozzle comprising:

a base section; and a fitting section connected to said base section and insertable into an end section of the tube so as to be fitted in the tube, said fitting section having an opening through which the pressurized fluid is ejected to be supplied into the tube, said fitting section having a generally rectangular cross-section, said fitting section including two conical projections whose axes are parallel with each other and axially extend.

6. A hydrostatic forming system comprising:

a die inside which a tube is located; and a nozzle including a base section, and a fitting section connected to said base section and insertable into an end section of the tube so as to be fitted in the tube, said fitting section having an opening through which pressurized fluid is ejected to be supplied into the tube, said nozzle having a generally rectangular cross-section, said fitting section including a tip end portion which is formed with first and second opposite surfaces; and a depression formed in at least one of the first and second opposite surfaces, said depression being located generally at a central part of the at least one of the first and second opposite surfaces in which it is formed.

7. A hydrostatic forming system as claimed in claim 6, further comprising a hydraulic cylinder to which said base section of said nozzle is connected, to press said fitting section of said nozzle into the end section of the tube.

8. A hydrostatic forming method for a tube, comprising:

preparing a nozzle for hydrostatic forming, through which pressurized fluid is supplied into the tube located inside a die, said nozzle including a base section, and a fitting section connected to said base section and insertable into an end section of the tube so as to be fitted in the tube, said fitting section having an opening through which the pressurized fluid is ejected to be supplied into the tube, said fitting section having a generally rectangular cross-section, said fitting section including a tip end portion which is formed with first and second opposite surfaces, said depression being located generally at a central part of the at least one of the first and second opposite surfaces in which it is formed;

locating the tube inside a die;

inserting said fitting section of said nozzle into an end section of the tube so as to be fitted in the tube end section; and supplying the pressurized fluid through the opening of said nozzle into the tube located inside the die.

9. A hydrostatic forming method as claimed in claim 8, wherein said inserting including pressing said fitting section of said nozzle into the end section of the tube by a hydraulic cylinder to which said base section of said nozzle is connected.

* * * * *